US005245721A

United States Patent [19]

Lowe et al.

[11] Patent Number: 5,245,721

[45] Date of Patent: Sep. 21, 1993

[54] COMBINATION TOOL

[76] Inventors: Joseph T. Lowe, 2324 Raintree Dr., Brea, Calif. 92622; Richard G. Lowe, Rte. 8, Box 104, Columbia, Mo. 65202

[21] Appl. No.: 838,522

[22] Filed: Feb. 19, 1992

[51] Int. Cl.[5] ..... B25F 1/04

[52] U.S. Cl. ..... 7/129; 7/107; 7/132; 7/165; 7/138

[58] Field of Search ..... 7/107, 125, 127, 129, 7/130, 132, 134, 165, 901, 167, 138, 170, 133; 81/305

[56] References Cited

U.S. PATENT DOCUMENTS

| | | | |
|---|---|---|---|
| 126,544 | 5/1872 | Heaton . | |
| 816,674 | 4/1906 | Medhus . | |
| 890,152 | 6/1908 | Mason . | |
| 1,079,997 | 12/1913 | Wernimont . | |
| 1,334,425 | 3/1920 | Wernimont . | |
| 1,514,488 | 11/1924 | Wernimont . | |
| 2,446,022 | 7/1948 | Peterson | 81/305 |
| 2,651,227 | 9/1953 | Kennington, Jr. | 81/305 |
| 3,858,258 | 1/1975 | Stevens | 7/5.1 |
| 4,238,862 | 12/1980 | Leatherman | 7/128 |
| 4,316,315 | 2/1982 | Vogelnik | 29/229 |
| 4,744,272 | 5/1988 | Leatherman | 81/427.5 |
| 5,014,379 | 5/1991 | Hull et al. | 7/127 |
| 5,033,140 | 7/1991 | Chen et al. | 7/127 |

FOREIGN PATENT DOCUMENTS

| | | | |
|---|---|---|---|
| 0085248 | 1/1895 | Fed. Rep. of Germany | 81/3.05 |
| 0537119 | 3/1922 | France | 81/3.05 |
| 0002223 | of 1888 | United Kingdom | 81/3.05 |
| 0125972 | 1/1919 | United Kingdom | 81/3.05 |
| 0658069 | 10/1951 | United Kingdom | 81/3.05 |

*Primary Examiner*—Roscoe V. Parker

*Attorney, Agent, or Firm*—Fulwider Patton Lee & Utecht

[57] ABSTRACT

A combination tool comprising multiple tool functions having swingable handles with shoulders formed integrally with the handles for alternately engaging two connected pairs of jaw elements. The jaw elements are biased open to a specific angular relation. Swinging the handles to engage a first pair of jaws allows the other pair of jaws to be used. Retaining means allow the jaw elements to be clamped closed against the force of the biasing means and held against one of the handles. This allows a tool included in the other handle to be more conveniently used and secures the jaws for storage of the tool. In one embodiment, the jaws comprise standard plier jaws, long nose plier jaws, a pipe grip, wire cutter, wire crimpers, and wire strippers and one handle includes a socket driver and scale and the other handle includes a storage compartment.

24 Claims, 4 Drawing Sheets

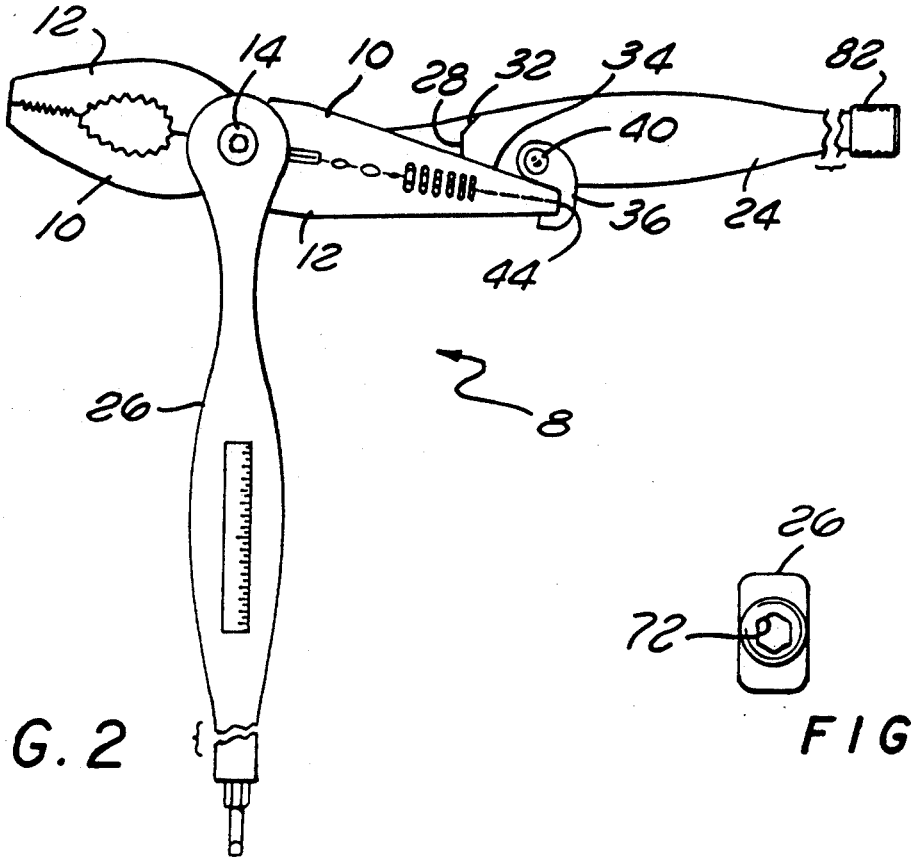
FIG. 2
FIG. 8
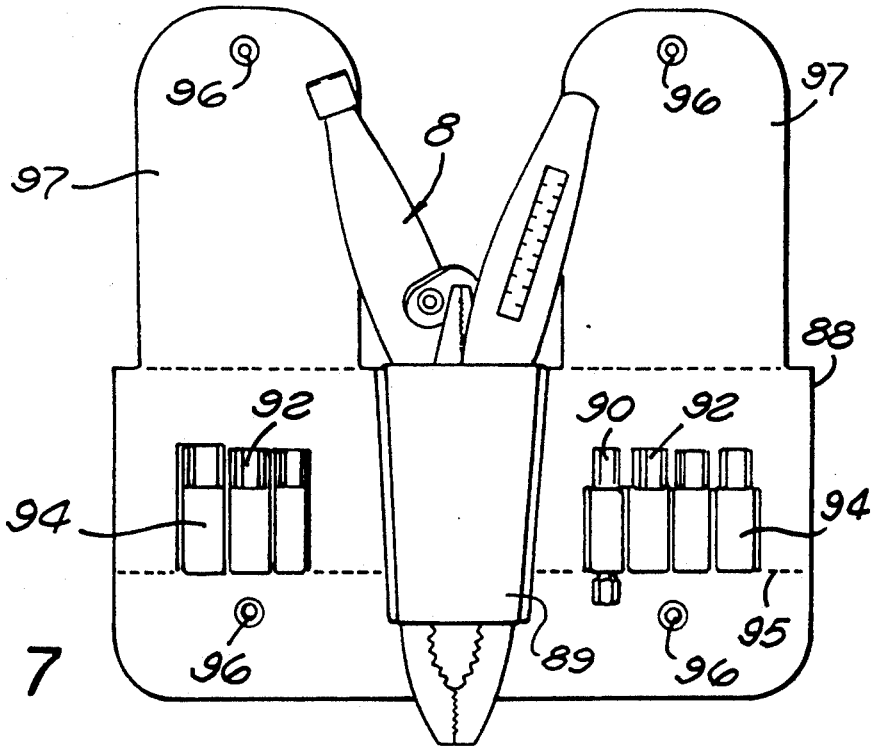
FIG. 7

COMBINATION TOOL

BACKGROUND

The invention relates generally to tools and more particularly to combination tools embodying more than one tool function in a single tool and having lever handles for controlling the action of jaw elements.

Many prior tools include only a single or sometimes two tool functions. To obtain a larger number of tool functions, for example ten tool functions, one may be required to have at least five tools. Carrying or storing many tools can be difficult in some situations and in such cases it is desirable to combine many tool functions into a single tool. Additionally, the cost of many tools compared to a single combination tool can be relatively high. It has been recognized by those skilled in the art that a single combination tool which provides numerous tool functions can be a preferably alternative to multiple tools.

Combination tools which include two pairs of jaws for providing multiple jaw tool functions have been provided in the past but have not included a single pair of free-swinging handles for actuating both pairs of jaws, or have not included a biasing means for positioning those jaws to a preferred position for use. In some prior tools having a single pair of handles, repositioning the handles for use with other parts of the tool required disassembly of the tool, repositioning the handles to the desired position, and then reassembly of the tool. This procedure requires time for disassembly and reassembly which the tool user may not desire to spend and exposes the disassembled tool to loss of its parts.

In using a tool having no biasing means with only one hand, manual dexterity is required to grasp a handle of the tool with some fingers on the hand and open the jaws by moving the other handle away from the first handle with another finger or fingers of the same hand. The jaws must be opened into the proper position for initial engagement with the workpiece. Two hands may be used to position the tool instead of just the one but than the second hand is not available to perform another task, such as holding the workpiece. Thus, in some cases, it is desirable to have automatic positioning of the jaws.

In certain prior combination tools having multiple jaws and swinging handles for actuating the jaws, the means for engaging and actuating the jaws does not provide a large surface area for applying the force against the jaws. A larger bearing surface gives rise to better durability and is therefore desirable.

Additionally, prior combination tools wherein multiple jaws are a feature typically do not include a socket drive means for accepting a socket driver or screw driver bits. In order to obtain greater versatility, a combination tool having jaw functions and a socket drive mechanism would be desirable.

Many prior combination tools also do not provide any means for retaining the jaws in a desired position. There are times, for example, when operation of a selected tool function or storage of the tool may be made easier by retaining the jaw elements in a fixed relation to each other and the rest of the tool. For example the use of a tool function embodied in one handle may be made easier by having the jaw elements retained securely shut and tucked out of the way against the other handle.

Those concerned with providing tools have recognized the desirability of providing a combination tool having a large number of tool functions to reduce the number of tools required to complete certain tasks. Those concerned have also recognized the desirability of providing a combination tool which has swinging handles for actuating multiple jaws and which contains a socket drive mechanism and yet is convenient to use. The present invention fulfills these needs.

SUMMARY OF THE INVENTION

The present invention provides a combination tool having jaw elements pivotally coupled together at a point intermediate their ends. The ends of each jaw element have different tool functions. A biasing means is included for positioning the jaw elements to a predetermined position in relation to each other. Further included is a pair of swingable handles for selective engagement with and actuation of the jaws. Each swingable handle has at least one shoulder for engaging the outer surface of a jaw element.

The combination tool in accordance with the principles of the invention comprises a plurality of tool functions. In one aspect, the jaw elements each comprise multiple tool functions. Also, in another aspect, the swingable handles include other functions. Thus a relatively large number of tool functions is provided. As an example, a socket is formed in the free end of one handle to receive releasably insertable tools such as a socket driver or screw driver bits. The other handle contains a tool storage compartment in which screwdriver bits usable in the socket of the other handle may be stored.

In accordance with one aspect of the invention, the jaw elements are coupled together at a pivot point by a pivot pin. The jaw elements are biased open by a biasing means coupled to the jaws and in one aspect, the biasing means comprises a "C" shaped spring having its ends bent at a 90° angle to the spring body. The bent ends are fitted into recesses formed in the individual jaw elements and the body of the spring is placed in a circular channel formed in the two jaw elements where they join.

The handles are pivotally coupled together at one end and swing between two engaged positions, the first position being abutted against the outside surfaces of the first ends of the jaw elements and a second position being abutted against the outside surfaces of the second ends of the jaw elements. In another aspect of the invention, each handle includes a shaped shoulder which abuts the outer surfaces of the selected jaw elements. The shoulder has multiple surfaces, shaped to engage the respective end of the jaw elements over a relatively large surface area. The surfaces and the shoulders are positioned such that the handles will be in the same angular relationship with each other, and thus the same distance apart at their ends, whether they are in the first or second position.

The shaped shoulder is formed from the handle itself. In one case, the shoulder comprises two engaging surfaces for contacting the jaw elements and both of the surfaces are cut into the thicker part of the handle. Having this thicker gripping portion of the handle in which the shoulder is formed moves the geometric center of the handles at the gripping portion toward the general plane of the tool transverse to the pivot axis in which the jaw elements rotate. Moving the geometric center of the handles inward in this manner reduces the undesirable moment resulting from out-of-plane forces and makes the tool less awkward to use.

In a further aspect of the invention, a retaining means is provided to hold the jaw elements together in a fixed position in relation to each other and to at least one of the handles. In the case, for example, where one handle includes a socket for use in a socket drive function, retaining the jaws in a fixed position relative to the other handle aids in the use of the socket-containing handle. The socket drive handle can then be positioned at a 90° angle from the retaining handle and the retaining handle along with the retained jaws can be used as a lever to apply increased torque on the bit or socket being used in the other handle. Additionally, the handles can be positioned at other angles relative to each other, such as 180° for extended length, or other angles for reaching into hard to reach places.

A carrying and storage means is provided to facilitate use of the combination tool. Means to carry accessory tools such as a socket set may be incorporated into the storage and carrying means for convenient use with the combination tool.

Other aspects and advantages of the invention will become apparent from the following detailed description and accompanying drawings, illustrating by way of example the features of the invention.

BRIEF DESCRIPTION OF THE DRAWINGS

FIG. 2 is a top elevation view of the combination tool of FIG. 1 with the jaws retained against one handle and the other handle swung to an angle of approximately 90°;

FIG. 7 is a side elevation view of a holster for storage of the combination tool in accordance with the present invention and storage of an adaptor and sockets for use therewith;

FIG. 8 is an end view of one of the handles of FIG. 1 having a socket formed therein.

DETAILED DESCRIPTION OF THE PREFERRED EMBODIMENTS

Figure 1:
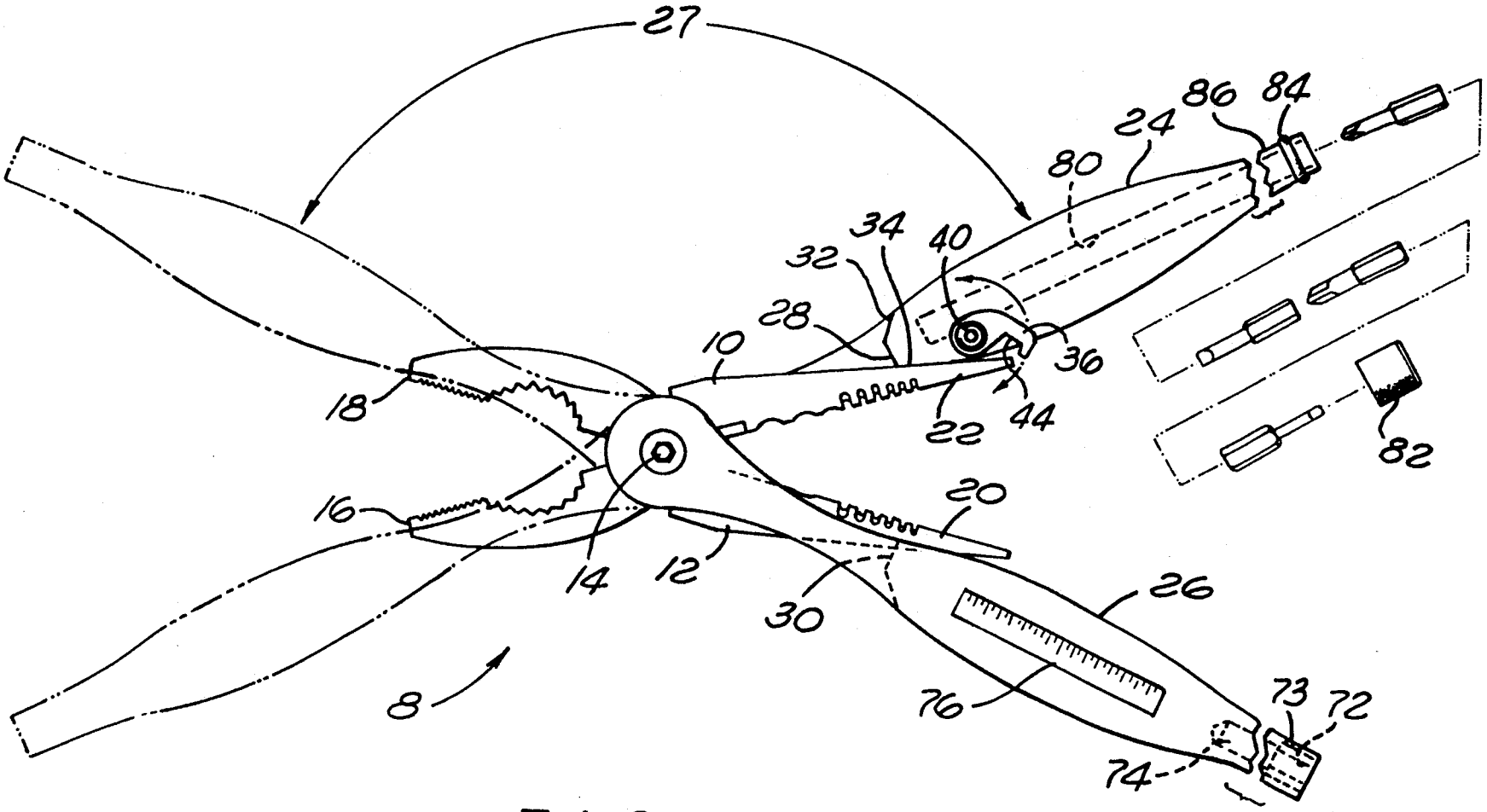
FIG. 1 is a top elevation view of a combination tool in accordance with the present invention with the handles secured at the pivot point of the two pairs of jaws elements and further showing examples of the multiple tool functions of the combination tool.
Figure 3:
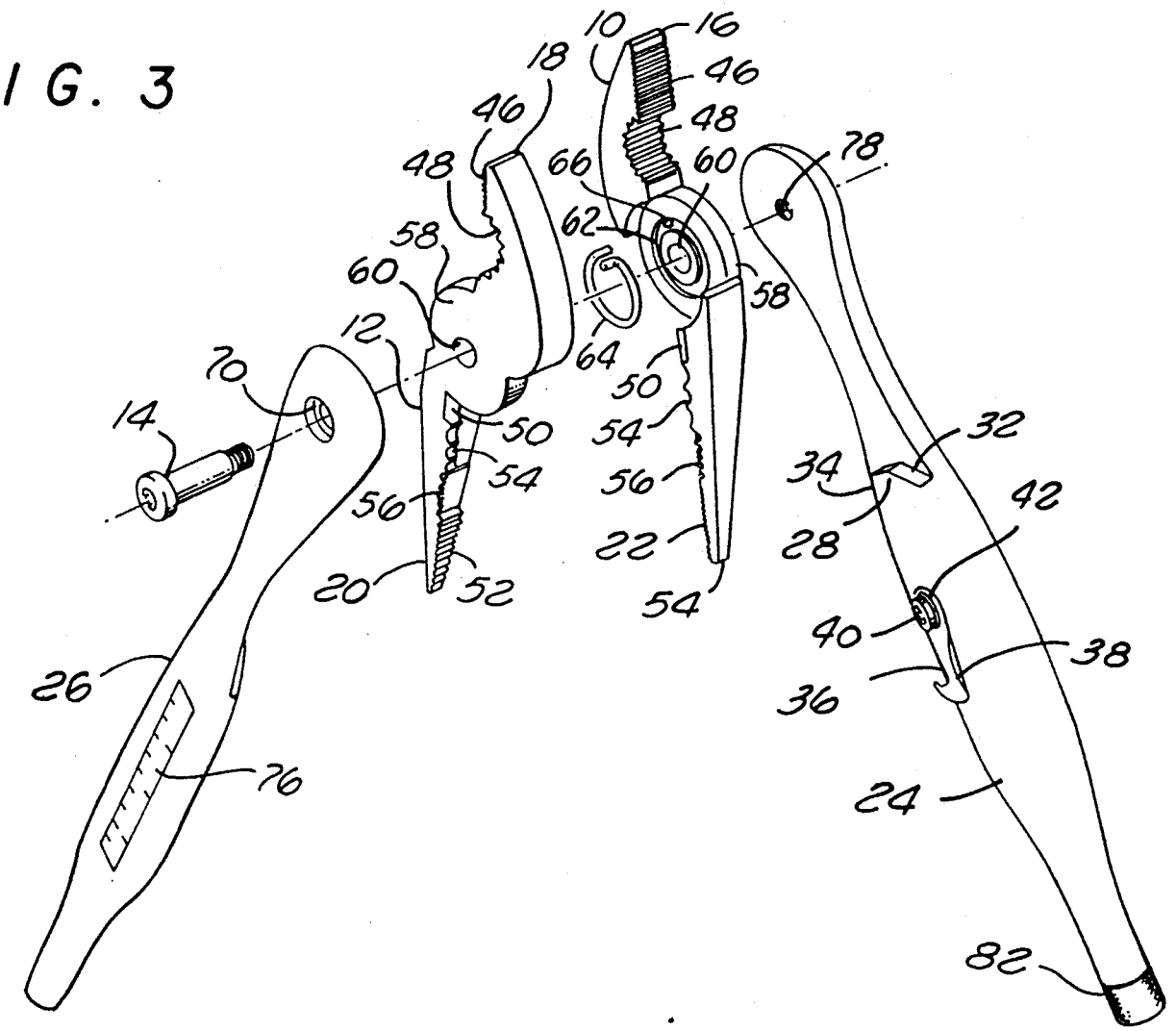
FIG. 3 is an exploded perspective view of a combination tool in accordance with the present invention.

Referring now to the drawings with more particularity wherein like reference numerals are used to indicate like or corresponding elements among the several views, in FIGS. 1, 2 and 3 there is shown a combination tool 8 having a pair of jaw elements 10 and 12 connected together by means of a pivot pin 14. The pivot point through which the pivot pin 14 is placed is intermediate the ends of the jaw elements 10 and 12. In the embodiment shown, the jaw elements comprise standard plier jaws formed at the first end 16 and 18 of each and long nose plier jaws formed at the second end 20 and 22 of each.

Swingable handles 24 and 26 are pivotally mounted in relation to each other and in the embodiment shown in the figures, are pivoted at one end. As also shown, the handles 24 and 26 are pivotally mounted at the same point as the pivot point of the jaw elements 10 and 12. The pivot pin 14 connects the jaw elements 10 and 12 and the handles 24 and 26 together at the same point. In this embodiment, the handles 24 and 26 swing between two primary positions. An example of the swinging action of one handle 24 is shown in FIG. 1 by the arc 27. The first position of the handles is indicated by their representations in solid lines and the second position of the handles is indicated by their representations in dashed lines in FIG. 1.

The handles 24 and 26 are generally identical in overall shape, each having a flared rounded shape at the pivot point, a narrowed circular shape at the free end and a thickened handle portion between the two ends.

Formed in each handle 24 and 26 is a jaw engaging shoulder 28 and 30 respectively. The shoulders 28 and 30 in the embodiment of FIG. 1 are formed into the thicker portion of the handles. The handles 24 and 26 are swung such that the shoulders 28 and 30 engage the jaw elements 10 and 12 which are not to be used for a tool function at that time. Continued movement of the handles 24 and 26 toward each other will cause the forces acting on the handles to be transferred to the jaw elements to actuate them. For example, when the handles 24 and 26 about the long-nose plier jaws 20 and 22 of the jaw elements as shown in FIG. 1, continued movement of the handles toward each other will cause the long-nose plier jaws 20 and 22 to move toward each other which in turn causes the standard plier jaws 16 and 18 to close.

Each raised shoulder 28 and 30 in the embodiment shown has two surfaces 32 and 34 angled to match the angle of the outer surfaces of the ends of the jaw elements 10 and 12 with which the shoulders engage. This is best illustrated in FIG. 1. As shown, the angle of the shoulder surface 34 for abutting the long-nose plier jaw of the jaw elements is lesser in relation to the centerline of the handle than the angle of the shoulder surface 32 for abutting the standard plier jaw. By shaping the engaging surfaces of the shoulders to match the outer surfaces of the jaw elements, a relatively large bearing surface area is established over which forces from the handle are applied to the jaw elements. The result is increased strength and durability; the tool is less likely to break.

Additionally, the position of the bearing surfaces 32, 34 of the raised shoulder of each handle is determined such that the handles 24 and 26 are biased to the same angular relationship about the pivot axis whether they are engaged against the standard plier ends 16 and 18 or the long-nose plier ends 20 and 22. This makes the combination tool according to the present invention easier to operate as the handles are the same distance apart, and thus have the same feel, at either end.

Forming the engaging shoulders in the handles themselves results in fewer parts of the tool. A separate pin or rivet or other separate device for providing the shoulders would include an additional part. Additionally, greater strength of the shoulder is gained because the shoulder is integral with the thicker part of the handle.

Having a thicker portion of the handles into which the shoulders 28 and 30 are formed results in the handles 24 and 26 being more in line with the general central plane of the combination tool 8. This general central plane is transverse to the pivot axis around which the jaw elements 10 and 12 and the handles 24 and 26 rotate in relation to one another. It is desirable to move the geometric centers of the handles 24 and 26 closer to the general central plane of the combination tool 8 to minimize forces acting through the handle members parallel to the general central plane but displaced from it. Such forces can cause the tool to tend to twist during use. The user must correct for this tendency to twist, and this in turn gives rise to unnecessary effort in using the tool and an awkward feel in use.

Prior art tools with swingable handles have handles laterally displaced from the general plane of the tool transverse to the pivot axis wherein the jaw elements rotate. A vector component of the forces acting through the handles is thus laterally displaced from, and parallel to, the general plane of the tool. This gives rise to an undesirable moment when the handles are squeezed together and force is applied engaging the jaw elements on a workpiece. This gives rise to a somewhat awkward feel for the user, as the user must correct for this undesirable moment. Correcting for the undesirable moment also gives rise to unnecessary effort for the user.

In another aspect in accordance with the invention, a retaining means is included to retain the jaw elements 10 and 12 in a fixed position in relation to each other and in relation to at least one handle. In the embodiment shown, the retaining means is a retaining clip 36 mounted on one handle 24. The retaining clip 36 is generally flat and is made of spring steel with one edge turned up to form a thumb grip 38 (FIG. 3). The clip 36 pivots about a button-head cap screw 40 which secures it to the handle 24. A spring washer 42, such as a Belleville washer, is disposed between the head of the button head cap screw 40 and the retaining clip 36 thereby urging the retaining clip 36 against the handle 24. A threaded hole is provided in the handle 24 to receive the button-head cap screw 40. The button-head cap screw has a hex socket for positioning the bolt, but may also be of the slot or phillips type. A thread locking compound such as Loctite TM is used to secure the button-head cap screw 40.

The use of a biasing means such as the Belleville washer 42 against the retaining clip 36 creates sufficient resistance to movement of the clip 36 that movement of it must be necessarily deliberate. Thus when moved to retain the jaw elements 10 and 12 as shown in FIG. 2, the clip 36 will remain in position unless deliberately moved. Similarly, when moved back to reside entirely over the handle 24, the clip 36 will remain out of the way unless deliberately moved otherwise.

In retaining the jaw elements 10 and 12, the handles 24 and 26 are swung to the long-nose plier side of the jaw elements 10 and 12 and the handles 24 and 26 are pressed together to engage their shoulders with the long-nose plier tips and force the tips together. The retaining clip 36 is then pivoted to engage both tips of the long-nose pliers in the slot 44 of the clip and lock them in place against the handle 24. The other handle 26 is then free to swing in relation to the jaw retaining handle 24. Where the free swinging handle 26 contains a socket drive as will be discussed below in more detail, the handle 26 can be swung to a position approximately 90° from the other handle 24 thereby allowing the retaining handle 24 to act as a lever in turning the socket driving handle 26 (FIG. 2). Where more length is desired, or a situation where access is restricted, the handles may be moved to any other relative position including 180°.

Figure 4A:
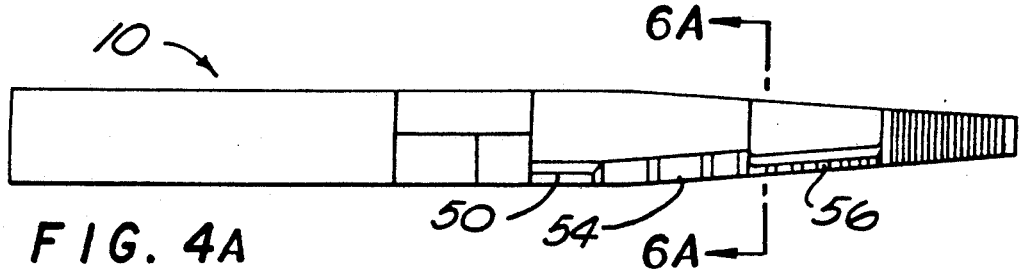
FIG. 4A is a side view of a jaw element.
Figure 4B:
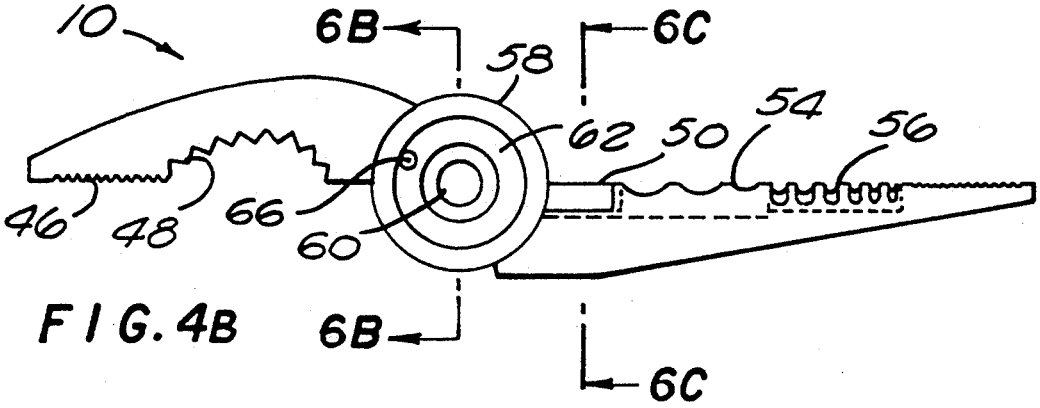
FIG. 4B is a top view of the jaw element of FIG. 4A.
Figure 4C:
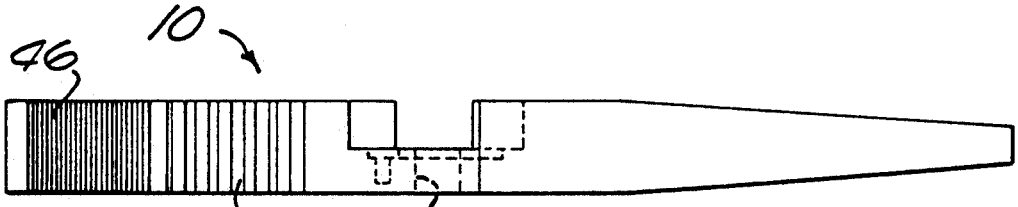
FIG. 4C is the opposite side view of the jaw element of FIG. 4A.
Figure 5B:
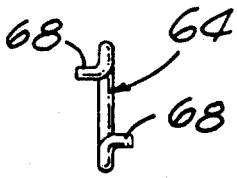
FIGS. 5A and 5B are top and side elevation views respectively of the spring element.
Figure 5A:
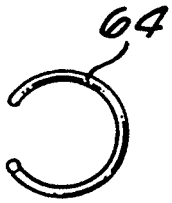

Referring primarily to FIG. 3 but also to FIGS. 4A, 4B and 4C, the jaw elements 10 and 12 in this embodiment are nearly identical and provide a standard plier configuration 46 and a pipe grip section 48 at the first ends 16 and 18 and a long-nose plier 52 configuration at the second ends 20 and 22. The second ends 20 and 22 also include a wire cutting section 50, a wire crimping section 54 and a wire stripping section 56.

The jaw elements 10 and 12 contain a cylindrical, central connection portion 58 disposed uniformly around the pivot point. The pivot pin 14 is placed through this area. The circular connection portion 58 contains a centrally located hole 60 for receiving the pivot pin 14 and a concentric channel 62 for receiving a spring element 64 when the two plier jaw elements are juxtaposed. Within the channel 62 on both jaw elements 10 and 12, a hole 66 is provided to receive a transversely bent end 68 of the spring element 64. The position of the hole within the channel is selected so that when the jaws 10 and 12 and spring 64 are assembled, the jaws 10 and 12 will be biased to a particular angular position as shown in FIG. 1. The channel 62 is sized somewhat larger than the spring element 64 to allow the spring 64 to expand and contract in a radial direction as the jaw elements 10 and 12 pivot.

The central circular connection portion 58 of the jaw elements 10 and 12 generally has a thickness of one-half that of the jaw elements generally. The central portion 58 of the jaw element is given a circular shape where not integral with the portion forming part of each end of the jaw element, to create a uniformly shaped pivot area when the two jaw elements 10 and 12 are joined together.

Figure 6A:
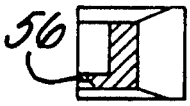
FIGS. 6A, 6B, and 6C are sectional views taken along respective lines of FIGS. 4A and 4B.
Figure 6B:
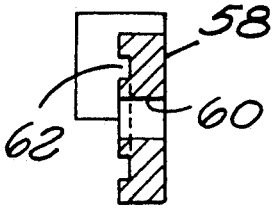
Figure 6C:
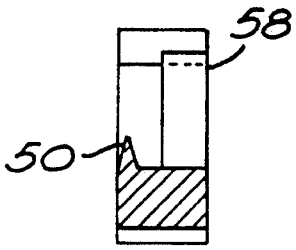

The jaw elements 10 and 12 are about 5.7 inches (14.5 cm) in length and are made of A2 tool steel in this embodiment. The jaw elements 10 and 12 are hardened as required for the proper functioning of the wire cutter 50, crimper 54 and stripper 56 sections. Alternatively, an insert of harder material may be used. Cross-sectional details of parts of FIGS. 4A and 4B are presented in FIGS. 6A, 6B and 6C.

Although the figures show the cutter 50, the crimper 54 and the stripper 56 sections formed into an edge of the jaw (FIGS. 3 and 4A), these sections may be formed along the centerline of the jaw. Forming these sections along the centerline instead of on an edge would enable the jaws to be identical, possibly reducing manufacturing and assembly costs.

Markings to aid the user are placed adjacent the wire cutter 50, crimper 54 and stripper 56 sections as exemplified in FIG. 1. These may for example identify the particular section or indicate the gauges of wire the particular portion of each crimping or stripping section is suited to work with. These markings may be applied for example by engraving, photo-engraving, etching or stamping methods.

The spring element 64 is a "C" spring generally circular in configuration and may be formed of music wire or other suitable spring material. The spring ends 68 are angularly spaced apart 80 degrees through the center of the spring to bias the plier jaw elements to a specific angular relation when juxtaposed and connected and to allow for radial contraction and expansion of the spring. The ends 68 are bent transversely at a 90 degree angle out of the general plane of the spring. The ends are bent in opposite directions and extend a short distance. Each spring end 68 engages a hole 66 in the channel of each of the two plier jaw elements to provide a specific angular relation between the plier jaw elements as previously described.

The handles 24 and 26 are about 8 inches (20.3 cm) in length and are made of No. 6061 T6 Aluminum alloy in one embodiment. However, other suitable materials having properties of high strength and low weight may be used. One handle 26 is provided with a recessed hole 70 at the pivot end to receive the pivot pin 14 (FIG. 3). The recessed hole 70 allows the top of the pivot pin 14 to be flush with the outer surface of the handle 26. The second handle 24 has a threaded hole 78 at its pivot end to receive the threaded end of the pivot pin 14 to securely hold the tool together.

One handle 26 has a hexagonal socket 72 included in its free end for use with removable tools, such as screwdriver bits or a socket driver, such as a ¼" drive, or an adapter for other socket sets (FIG. 1). Socket 72 may comprise a hardened steel insert screwed into the handle 26 and pinned in place by pin 73. A thread locking adhesive, such as Loctite TM is used to further secure the insert. A magnet 74 is included in a receptacle behind the socket 72 to releasably hold the removable tools in place in the socket 72. The magnet 74 may be of the alnico or rare-earth type, and may be pressed into the handle 26 or held in place by use of an epoxy or other adhesive, or by a hardened steel insert comprising the socket if such is used. Alternatively, a detent ball mechanism (not shown) may be employed to releasably secure the bits or socket driver.

A measuring scale 76 is included in the handle 26 having the socket drive 72. The measuring scale 76 is engraved and includes both english and metric (not shown) units. The measuring scale 76 may alternatively be provided by other methods such as photo-engraving, etching or stamping.

The second handle 24 includes a generally tubular magazine 80 along its central axis for storing removable tools usable in the socket drive 72 such as screwdriver bits, and has a cap 82. A rubber O-ring 84 is provided in a circumferential channel near the shoulder 86 of the handle 24 which cooperates with a circumferential channel (not shown) in the inside surface of the cap 82 to releasably secure the cap element to the free end of the handle 24. The O-ring may be made of elastomeric material and therefore also serves to provide a watertight seal between the cap and the handle. Alternatively a threaded cap may be used. The cap is preferably made of aluminum.

The pivot pin 14 is a hex-head low profile shoulder bolt of hardened steel. It has a threaded end portion to engage threaded hole 78 in handle 24 and a smooth central portion to cooperate with the central hole 60 through the plier jaw elements 10 and 12 to give smooth and reliable operation of the pivoting jaw elements and handles. The head of the shoulder bolt 14 is received in recessed hole 70 so that the head is level with the outer surface of the handle 26 as before discussed.

Referring now to FIG. 7, a separate protective carrying pouch 88 made of leather or other suitable material is provided for storage and for carrying the combination tool 8 and accessories. The pouch 88 has a holster 89 for carrying the combination tool 8 and smaller pouches 94 for the storage of a socket driver 90 and various sockets 92 comprising a socket set to be conveniently used with the combination tool 8. The sockets 92 and driver 90 are held in place by folding the flaps 97 over them and engaging the flap snaps 96 with corresponding snaps 96 under the smaller pouches 94. Another piece of material is attached to the back of the pouch 88 as a belt loop to receive a belt for carrying the pouch 88. The stitching of the belt loop is indicated by numeral 95. Other means besides a belt loop may be used for carrying the pouch 88. Referring now to FIG. 8, an end view of the handle 26 of FIG. 1 containing the socket 72 is shown.

From the foregoing, it will be appreciated that the combination tool in accordance with principles of the present invention embodies a plurality of tool functions into one convenient tool. This eliminates the need to purchase, store or carry multiple tools otherwise required to perform the same tool functions.

While a particular form of the invention has been illustrated and described, it will also be apparent that various modifications can be made without departing from the spirit and scope of the invention. Accordingly, it is not intended that the invention be limited, except as by the appended claims.

What is claimed is:

1. A combination tool comprising:

first and second jaw elements juxtaposed such that a first pair of jaws are formed at the first ends of the jaw elements and a second pair of jaws are formed at the second ends of the jaw elements, the jaw elements being rotatable relative to one another about a transverse axis;

biasing means for biasing the jaw elements to a specific angular relationship to one another about the transverse axis;

first and second handles interconnected with each other and with the jaw elements such that the handles are swingable between a first position at which they engage the first ends of the jaw elements and a second position at which they engage the second ends of the jaw elements, each handle having a shoulder means for engaging the first and second ends of the jaw elements for transferring force applied to the handles to the jaw elements; and retaining means for holding the jaw elements together in a closed position.

2. The combination tool of claim 1 wherein the shoulder means is formed into and is integral with a portion of each handle.

3. The combination tool of claim 1 wherein each shoulder means comprises a single shoulder having two surfaces angled to match the shape of the outer surfaces of respective first and second ends of the jaw elements.

4. The combination tool of claim 1 wherein the shoulder means are positioned on the handles such that the two handles are in the same angular relationship to one another about the transverse axis when they are either engaged with the first ends or the second ends of the jaw elements.

5. The combination tool of claim 1 wherein a first end of the jaw elements form a first type of pliers and a second end of the jaw elements form a second type of pliers different than the first.

6. The combination tool of claim 1 further comprising a drive socket formed in one of the handles for use with removable tool elements.

7. The combination tool of claim 6 wherein the drive socket contains a magnet positioned so as to bias removable tool elements into the socket.

8. The combination tool of claim 7 wherein:

the socket is formed in the first handle;

the second handle comprises:

a magazine for storing removable tool elements; and a cap for covering the magazine.

9. The combination tool of claim 1 wherein:

a drive socket is formed in the first handle for use with removable tool elements;

the second handle comprises the retaining means for holding the jaw elements together and for holding the jaw elements in a fixed position relative to the second handle.

10. The combination tool of claim 1 wherein the biasing means is positioned between the jaw elements to position the jaw elements to the specific angular relationship.

11. The combination tool of claim 10 wherein the biasing means comprises a C-shaped spring element having ends turned 90 degrees in opposite directions from the general plane of the spring to engage holes in each respective jaw element within a circular channel between jaw elements to provide for a specific angular relation between the jaw elements when the spring is at rest.

12. The combination tool of claim 1 further comprising a portable storage means for storing and carrying the combination tool.

13. A combination tool comprising:

first and second jaw elements juxtaposed such that a first pair of jaws are formed at the first ends of the jaw elements and a second pair of jaws are formed at the second ends of the jaw elements, the jaw elements being rotatable relative to one another about a transverse axis;

biasing means positioned between the jaw elements for biasing the jaw elements to a specific angular relationship to one another about the transverse axis;

first and second handles interconnected with each other and with the jaw elements such that the handles are swingable between a first position at which they engage the first ends of the jaw elements and a second position at which they engage the second ends of the jaw elements, each handle having a shoulder means for engaging the first and second ends of the jaw elements for transferring force applied to the handles to the jaw elements wherein each shoulder means comprises a single shoulder having two surfaces angled to match the shape of the outer surfaces of respective first and second ends of the jaw elements; and retaining means for holding the jaw elements together in a closed position.

14. The combination tool of claim 13 wherein the shoulder means is formed into and is integral with a portion of each handle.

15. The combination tool of claim 14 wherein the shoulder means are positioned on the handles such that the two handles are in the same angular relationship to one another about the transverse axis when they are either engaged with the first ends or the second ends of the jaw elements.

16. The combination tool of claim 13 wherein the biasing means comprises a C-shaped spring element having ends turned 90 degrees in opposite directions from the general plane of the spring to engage holes in each respective jaw element within a circular channel between jaw elements to provide for a specific angular relation between the jaw elements when the spring is at rest.

17. A combination tool comprising:

first and second jaw elements juxtaposed such that a first pair of jaws are formed at the first ends of the jaw elements and a second pair of jaws are formed at the second ends of the jaw elements, the jaw elements being rotatable relative to one another about a transverse axis;

a C-shaped spring element having ends turned 90 degrees in opposite directions from the general plane of the spring to engage holes in each respective jaw element within a circular channel between the jaw elements to provide for a specific angular relation between the jaw elements when the spring is at rest;

first and second handles interconnected with each other and with the jaw elements such that the handles are swingable between a first position at which they engage the first ends of the jaw elements and a second position at which they engage the second ends of the jaw elements, each handle having a shoulder means for engaging the first and second ends of the jaw elements for transferring force applied to the handles to the jaw elements wherein each shoulder means comprises a single shoulder having two surfaces angled to match the shape of the outer surfaces of respective first and second ends of the jaw elements; and retaining means for holding the jaw elements together in a fixed position wherein their first ends are touching.

18. The combination tool of claim 17 wherein:

a drive socket is formed in the first handle for use with removable tool elements; and the second handle comprises the retaining means for holding the jaw elements together and for holding the jaw elements in a fixed position in relation to the second handle.

19. The combination tool of claim 1 wherein the retaining means is mounted on one of the handles and comprises a retaining clip which engages the jaw elements to hold them together in a fixed position in relation to said handle on which the retaining clip is mounted.

20. The combination tool of claim 19 wherein the first and second handles are swingable to an extent that they may be swung apart to form an angle of approximately 180 degrees between themselves.

21. The combination tool of claim 13 wherein the retaining means is mounted on one of the handles and comprises a retaining clip which engages the jaw elements to hold them together in a fixed position in relation to said handle on which the retaining clip is mounted.

22. The combination tool of claim 21 wherein the first and second handles are swingable to an extent that they may be swung apart to form an angle of approximately 180 degrees between themselves.

23. The combination tool of claim 18 wherein the retaining means is mounted on one of the handles and comprises a retaining clip which engages the jaw elements to hold them together in a fixed position in relation to said handle on which the retaining clip is mounted.

24. The combination tool of claim 23 wherein the first and second handles are swingable to an extent that they may be swung apart to form an angle of approximately 180 degrees between themselves.

* * * * *